United States Patent [19]

McCormick

[11] Patent Number: 5,047,384

[45] Date of Patent: Sep. 10, 1991

[54] CARBONLESS MULTIPLE PLY CREDIT CARD TRANSACTION FORM

[75] Inventor: Joseph A. McCormick, Manhattan, Ill.

[73] Assignee: General Credit Forms, Inc., Earth City, Mo.

[21] Appl. No.: 376,590

[22] Filed: Jul. 7, 1989

[51] Int. Cl.[5] ..... B41M 5/132

[52] U.S. Cl. ..... 503/226; 282/18; 503/200

[58] Field of Search ..... 282/8 A, 8 R, 9 R, 23 R, 282/27 R, 28 R; 283/66.1; 428/914; 503/200, 226

[56] References Cited

U.S. PATENT DOCUMENTS

| | | | |
|---|---|---|---|
| 3,113,516 | 12/1963 | Johnson | 282/22 R |
| 3,290,060 | 12/1966 | Ruddock et al. | 282/22 |
| 3,973,788 | 8/1976 | Pekko et al. | 282/28 R |
| 3,981,523 | 9/1976 | Maalouf | 282/28 R |
| 4,045,053 | 8/1977 | Carriere | 282/22 |
| 4,512,595 | 4/1985 | Breen | 283/70 |
| 4,611,826 | 9/1986 | Breen | 282/8 R |
| 4,614,362 | 9/1986 | Breen et al. | 282/9 |
| 4,614,363 | 9/1986 | Breen | 282/9 R |
| 4,674,771 | 6/1987 | Thompson | 282/8 R |
| 4,730,848 | 3/1988 | McCormick | 282/8 R |

*Primary Examiner*—Bruce H. Hess

*Attorney, Agent, or Firm*—Marshall, O'Toole, Gerstein, Murray & Bicknell

[57] ABSTRACT

This invention relates to a carbonless multiple ply credit card form. The top ply of the form is a substantially translucent ply which is stacked on top of at least a second ply. When the two plies are contacted under sufficient pressure, a chemically produced positive visible image results on both the bottom surface of the substantially translucent ply and the top surface of the second ply. The image on the bottom of the translucent ply is readable when viewed through the ply.

29 Claims, 2 Drawing Sheets

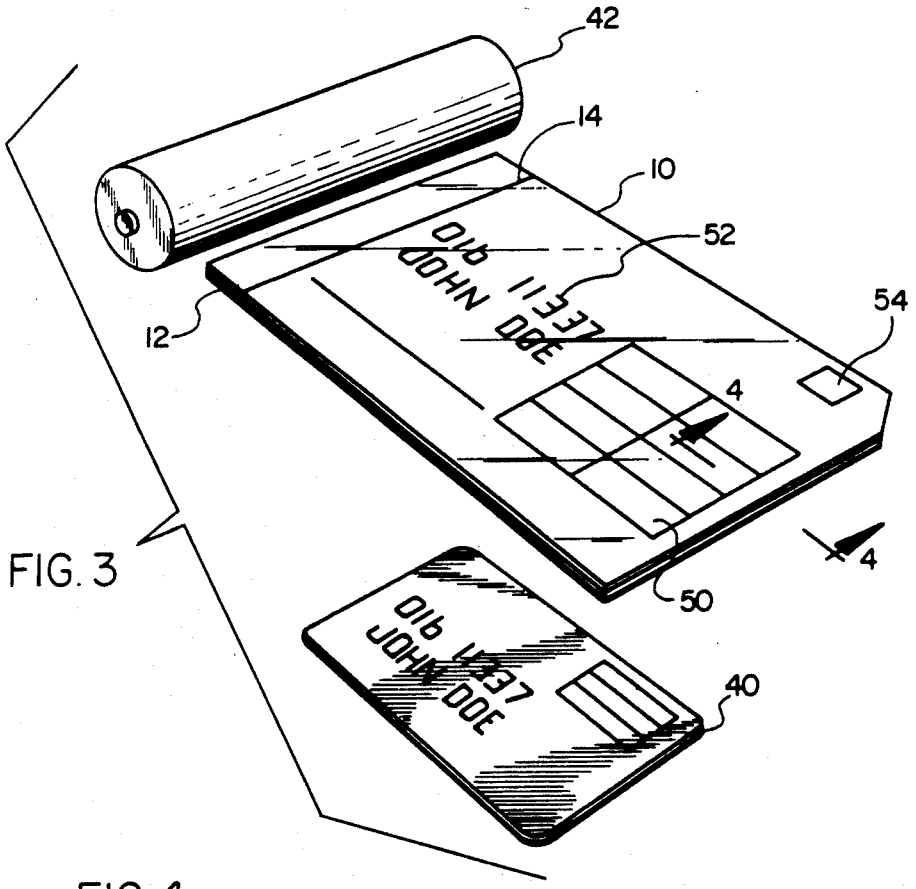
FIG. 3
FIG. 4
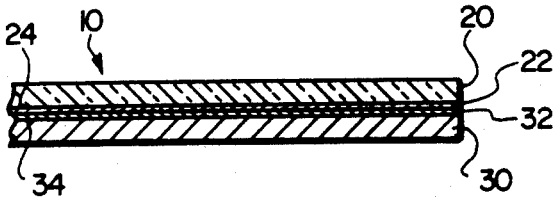
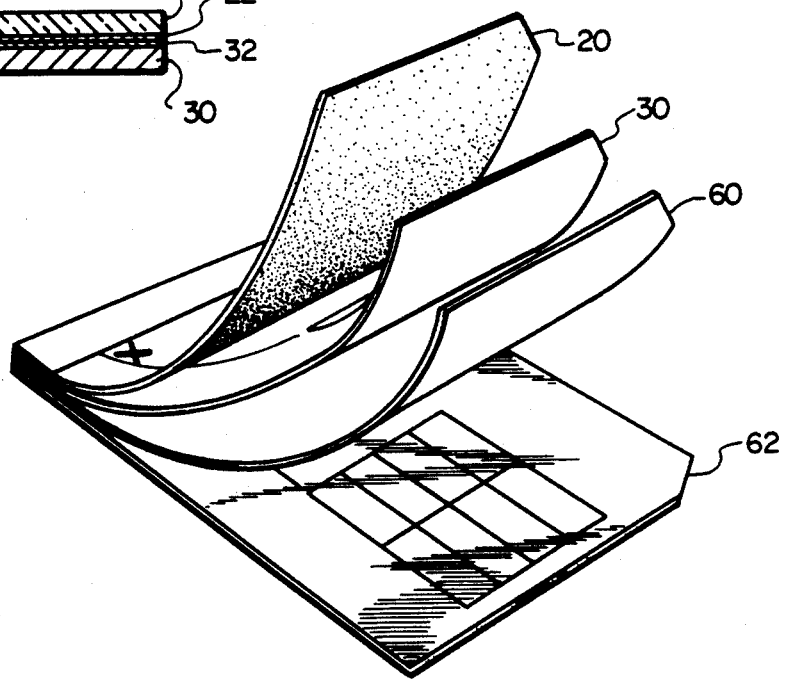
FIG. 5

CARBONLESS MULTIPLE PLY CREDIT CARD TRANSACTION FORM

This invention relates to a credit card transaction form and, in particular, to a carbonless, multiple ply form which, when imprinted with a credit card, places positive images on both the lower surface of a substantially translucent top ply and on the top surface of the adjacent ply.

BACKGROUND OF THE INVENTION

Credit card transaction forms are commonly used for business dealings recorded with the use of consumer credit cards. In normal business use, two or more identical copies are made of a single exchange. Each copy generally includes confidential information such as the customer's name, account number and the expiration date of the card as well as other information such as the merchant's name and account number.

Typically, this information is imprinted on the form when sufficient pressure is applied against the form. To make an imprint of the credit card, the form is sandwiched between an embossed customer credit card and a pressure applying roller. The embossed information from the face of the credit card is imprinted on the surfaces of the various plies making up the form. Alternatively, in a point of sale environment where machines read the information encoded on a magnetic strip attached to the credit card, the encoded information which is read by a machine may be transferred to the transaction form by an impact printer, a cash register or a similar machine. In addition, the pressure applied by a hand held stylus is sufficient to make an imprint on each ply of the form.

Several methods of imprinting the information on the plies of the form are routinely practiced. Historically, imprintable bond paper plies of the form were separated by carbon coated tissue paper plies. As a roller moved over a transaction form disposed upon an embossed credit card, pigment was transferred mechanically from the surface of the carbon tissue paper to the bond paper ply. The mechanical transfer of carbon pigment necessarily resulted in a negative image of the imprint being formed on the carbon tissue paper. Careless handling or disposal of the carbon tissue paper with the negative image disposed thereon compromised the security of the imprinted information. Additionally, forms using carbon tissue paper often could be smudged as an individual inadvertently contacted the carbon sheet and transferred the carbon onto other parts of the form or onto the individual's hands or clothing. An example of this type of transaction form is illustrated in U.S. Pat. No. 3,113,516.

More recently, plies coated with colorless, chemically reactive dyes, which produce a visible image when subjected to pressure, have been used to make carbonless transaction forms. The reactive dyes are typically used in a two part system. One part contains a colorless reactive dye and the second part contains agents which initiate the chemical reaction needed to change the colorless dye into a visible dye. An example of a carbonless dye system used in a business form is described in U.S. Pat. No. 3,981,523.

Generally, the back of one ply is coated with the colorless reactive dye and the front of the immediately adjacent ply is coated with the requisite visualizing agents. When the two plies are placed in contact under sufficient pressure, the colorless reactive dye and the visualizing agents react and create an image on the ply coated with the visualizing agent. Generally, no image is desired or observed on the ply surface coated with the colorless dye. If the top face of a top ply of standard carbonless forms is to be imprinted and a visual image is to appear, it must have a coating mix of both the colorless reactive dye and the visualizing agent applied to the top face of the top ply in order to generate a visible image on the top face when it is subjected to sufficient pressure to cause the desired reaction.

These carbonless forms suffer from a number of disadvantages in that they use proprietary dyes and chemicals, require relatively complicated manufacturing machinery and special application processes, and are relatively expensive. It is generally required that, in applications calling for carbonless paper forms, one must purchase bond paper that has been coated with special agents to achieve an image on the top ply. The cost of such coated bond paper is quite high.

The use of a transparent, translucent, semi-translucent or treated semi-translucent top ply on a business form is also practiced in the industry. In known forms, the top read-through ply may be imprinted with an image on the bottom surface of the top ply, the image being made by mechanically or physically transferring pigment from either an adjacent carbon tissue paper ply or from a transferable pigment applied on an adjacent bond paper ply. Unfortunately, in both instances there is an actual, physical transfer of pigment from one ply to another such that both methods of pigment transfer generate an undesired negative image either on the adjacent carbon tissue paper ply or on the adjacent pigmented bond paper ply. An example of a form which provides a negative image on a ply is seen in U.S. Pat. No. 3,981,523. The physical transfer of pigment also creates problems in that there is an increased opportunity for smeared or smudged copies due to inadvertent physical transfer of pigment from one ply to another. In addition, special coatings may be needed on the pigment receiving ply as well as the pigmented bond paper ply which again requires relatively costly application equipment and processes.

What is desired is a transaction form which has the simplicity and security of a carbonless form but which utilizes a translucent top ply on the form as opposed to other expensive top plies such as coated bond paper. It also is desired to have a transaction form which, when imprinted with information from an embossed credit card or transaction card disposed under the bottom ply of the form, yields positive images on both the back surface of the top translucent ply and the top surface of the adjacent ply without the use of carbon black, carbon red, or any carbon pigmented dye. It is further desired to have a carbonless form which does not utilize a coated bond paper on the top ply but which has a top ply that can be produced from generally available, inexpensive translucent paper which may be easily coated with one or more chemically reactive agents without the need for special processing techniques and machinery.

SUMMARY OF THE INVENTION

The present invention addresses the problems associated with various transaction forms presently available. The invention disclosed and claimed herein provides a carbonless transaction form which minimizes or eliminates the problems associated with currently available transaction forms and which also satisfies the above-referenced desires sought for a carbonless transaction form.

Briefly, the present invention encompasses a carbonless, multiple ply business form having a plurality of transaction slips providing multiple copies of a transaction when the form is imprinted by an imprinting machine using a card having an embossed surface, by an imprinting machine or an impact printer utilized in point of sale transactions or by a hand held stylus. The form includes a first substantially translucent ply, as that term is defined herein, in stacked relationship with a second ply. Colorless, chemically reactive, positive image producing agents are applied to the lower surface of the translucent ply and to the upper surface of the second, adjacent ply. When sufficient pressure is applied to the top surface of the translucent sheet of the two ply form by placing the form over an embossed card located underneath the second ply in an imprinting machine, by handwriting, or by placing the form in an impact printer, the image producing agents on the two adjacent surfaces of the plies react to produce a visible, positive image on both the bottom surface of the top ply and the top surface of the second ply.

Papers coated with carbonless, chemically reactive agents, which react to produce positive images under the application of direct or indirect pressure, are commercially available. Preferred carbonless coatings for use in this invention are generally made by coating a surface of one ply with a variety of micro-encapsulated colorless, chemically reactive dyes and coating an adjacent surface of another ply with a chemically reactive resin. When the two surfaces are brought together under pressure, the encapsulated dyes burst from the microcapsules, contact the reactive resin and chemically react to produce an intense visible, positive image on the resin coating and a less intense visible, positive image on the microencapsulated dye coating. Both positive images have been found to be sufficient for use in credit card transaction forms.

A substantially translucent ply used in the transaction form of the present invention may be either a translucent or semi-translucent paper. Either type of paper may have one surface coated with a pigment coating such as described in U.S. Pat. No. 4,730,848, entitled "Credit Card Transaction Slips Pack and Method of Making." The disclosure of the pigment coating set forth in the '848 patent is incorporated by reference herein. The color of the pigment coating is selected to improve legibility and to provide a background that contrasts with the color of the imprinted image. A preferred pigment coating is a white opaque ink which contrasts with the dye of the blue or black visible image. Alternately, other known transparent or translucent papers may be used as the translucent ply if these papers have characteristics similar to the paper made pursuant to the method described in U.S. Pat. No. 4,730,848.

In use, the carbonless, multiple ply form generally is placed in an imprinting machine with the form located over the embossed surface of a credit or other transaction card. Pressure is applied across the top of the entire form usually by a pressure roller mounted on the machine. As pressure is applied, an image producing chemical reaction occurs and a visible, positive image is generated on both the back surface of the top translucent ply and the adjacent ply. Both images are noticeably viewable to a viewer. Generally, the top ply is retained by the customer whereas the second ply is retained by the merchant or bank who desire a copy of the transaction imprinted with a positive image. Moreover, all surfaces of the plies are relatively smear and smudge-proof.

The form makes use of a translucent paper which permits one to read a positive image generated on the bottom surface thereof by viewing the paper from the top surface. Further, the translucent paper utilized is relatively inexpensive compared to coated bond paper plies previously used.

Advantageously, the process for making the top ply is relatively inexpensive which will serve to reduce the manufacturing costs associated with this type of transaction form.

Further advantages will become apparent based upon a description of the drawings and a detailed description of the invention.

BRIEF DESCRIPTION OF THE DRAWINGS

The novel features of this invention may be understood by reference to the embodiments illustrated in the accompanying drawings, viewed in conjunction with consideration of the following description.

FIG. 3 shows a perspective view of the multiple ply form and illustrates the form, after imprinting, with the imprinted information on the bottom surface of the translucent top ply being visible to a viewer observing the form from the top surface;

FIG. 4 shows a fragmentary, section view taken along section lines 4—4 in FIG. 3 and illustrates the coated layers on the respective surfaces of the multiple plies; and, FIG. 5 shows an alternative embodiment of the invention in which the transaction form comprises four plies.

DETAILED DESCRIPTION

Figure 1:
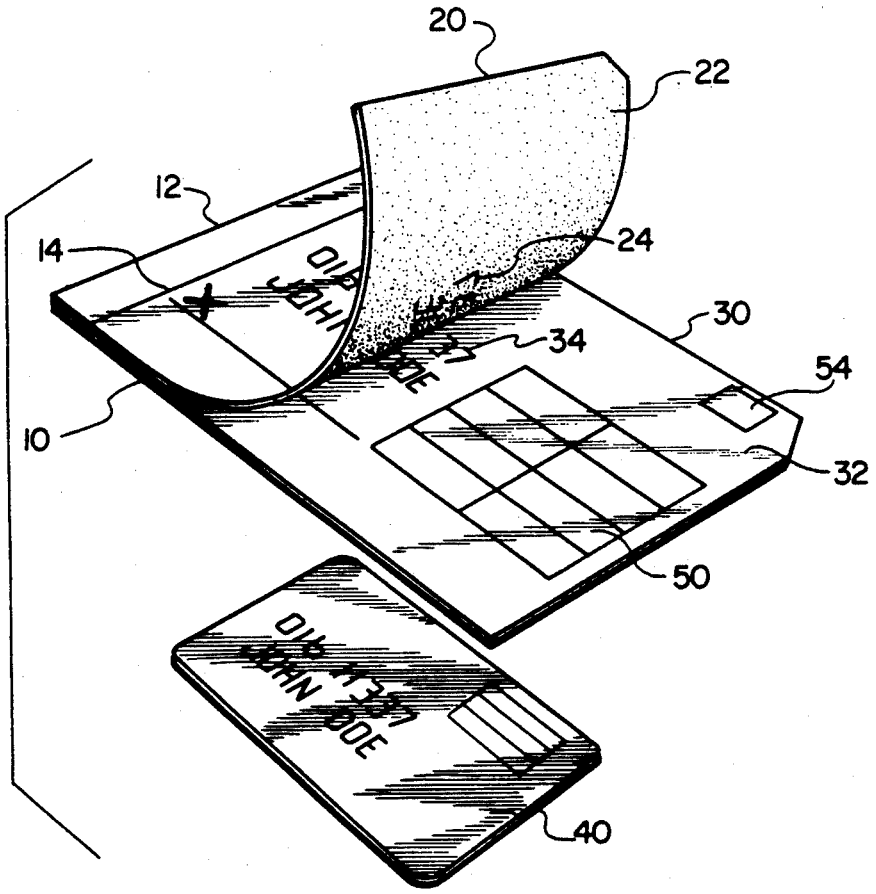
FIG. 1 shows a perspective view of the multiple ply form of the present invention and shows positive images on adjacent plies.
Figure 2:
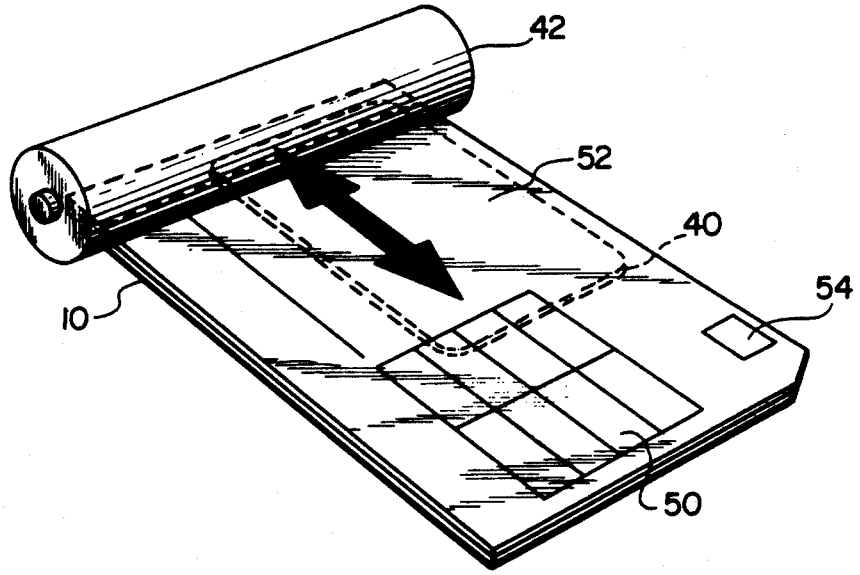
FIG. 2 shows a pressure roller applying force to generate a visible, positive image on various plies of the transaction form of FIG. 1 with a credit card having an embossed surface disposed below the form.

FIG. 1 of the drawings shows a carbonless two-ply transaction form 10. Top ply 20 comprises a substantially translucent ply disposed or stacked on top of a second, adjacent ply 30, each ply as described hereafter having a visible, positive image producing agent on adjacent surfaces thereof. When the two plies are imprinted in a machine or sandwiched under sufficient pressure between credit card 40 and pressure roller 42 located on a conventional imprinting machine, not shown, a chemically produced, visible, positive image is produced on both bottom surface 24 of substantially translucent ply 20 and top surface 34 of second ply 30. When a viewer looks at the top of the form, the viewer will see the positive image imprinted on bottom surface 24 of ply 20.

For purposes of illustration and clarity of understanding, the drawings and description are directed to an embodiment of the invention in which the credit card form includes two plies, substantially translucent top ply 20 and second ply 30. One of ordinary skill in the art would readily be able to add one or more additional plies to the form using materials and processes readily available and known in the art. Thus, forms with three, four, or more plies are all within the scope of the appended claims. FIG. 5, for example, shows a four ply form with plies 20 and 30 as well as two additional plies 60 and 62. Plies 60 and 62 may also provide imprinted copies of the transaction. These additional plies are made from known materials and are attached to the form using known techniques. A preferred embodiment contains three plies which provides copies of a business transaction to the customer, the merchant and the credit card issuer or processor.

The multiple plies of the form are typically held together along one end 12 of the plies by use of a suitable adhesive which joins adjacent ply ends to one another. Preferably, each ply also is perforated at 14 contiguous to end 12 in order to allow the plies to be readily separated from each other.

Referring to FIG. 1, top substantially translucent ply 20 and second ply 30 include a plurality of positions 50 where desired information is recorded. This information may include the item purchased, the sales price, the date, and the signature of the card holder. Of course, other information may also be recorded at any desired position on the form. Additionally, information embossed on the surface of credit card 40 is also recorded on the form. The imprint from the card itself is typically recorded at the top portion of position 52 on form 10. In addition, a typical credit card imprinting machine often will serve to imprint the name, address and account number of the merchant at the bottom portion of position 52. Some credit card imprinting machines will apply the date of the transaction at position 54.

The phrase "substantially translucent ply," as used herein, means a translucent or semi-translucent ply having the ability to receive a positive image on one surface or side of the ply which may be read relatively easily by an observer viewing the ply from the opposite surface or side. A substantially translucent ply generally has the property of admitting and diffusing light so that objects viewed through a translucent medium are visible but cannot be clearly distinguished. A preferred substantially translucent ply for use in this invention is a translucent or semi-translucent paper where one surface of the paper is coated with a pigment coating. Preferably, the color of the pigment coating is selected to improve legibility and to provide a background that contrasts with the color of the imprinted image. A semi-translucent manufactured paper having similar characteristics may also be used.

A white opaque ink is a suitable pigment coating which may be applied to the lower surface of a specialty or commodity grade translucent paper or semi-translucent paper. This white opaque ink, when applied to a translucent paper, contrasts with different imprinted image colors which are generally black, blue, red, or green. A suitable coating on a translucent paper is described in U.S. Pat. No. 4,730,848.

To generate the positive image on the translucent ply, colorless, chemically reactive, positive image producing agents are applied to lower or bottom surface 24 of translucent ply 20 to give layer 22 and to upper surface 34 of second ply 30 to give layer 32 as shown in FIG. 4.

The phrase "colorless, chemically reactive, positive image producing agents," as used herein, means any system of agents which, when chemically reacted, form a visible, positive image on adjacent surfaces of mating plies after being subjected to a sufficiently applied force. A form which yields a chemically produced positive image may be readily distinguished from a form in which a mechanical transfer provides a positive image on one surface of one ply and a corresponding negative image on an adjacent surface of another ply such as described in U.S. Pat. No. 4,614,363. In most mechanical transfer systems it has been found that the transferable pigment may undesirably rub off on ordinary paper, clothing, or skin, and may be easily smudged if it is handled casually.

Preferred positive image producing agents are known, colorless dyes that generally will not produce visible color or will seldom smudge when placed in contact with ordinary paper, clothing, or skin. When the dyes, however, are placed in contact with a chemically reactive agent, they will form an intense color. Preferred image producing agents generally are made of a two part system. One agent includes colorless dyes contained in breakable microcapsules. A second agent includes a coatable resin which reacts on contact with the colorless dyes to develop a color. To produce an image, the two agents are contacted and, under sufficient pressure, the microcapsules are ruptured. The colorless dyes are released and react with the coatable resin to form a positive image.

Carbonless transaction forms having plies or faces coated with a two agent image producing system are described in U.S. Pat. No. 3,981,523. A known, commercially available two-part system is sold under the trademark NCR Paper®, by Appleton Paper Inc., Appleton, Wis. Compatible carbonless paper manufacturers include Boise Cascade Paper Group, Mead Paper and others.

In addition, a coatable resin which may be used to apply layer 22 to lower surface 24 of top ply 20 is also commercially available from Appleton Paper Inc. The coatable resin may be applied to papers using techniques well known to those of ordinary skill in the printing arts.

One coatable resin commercially available from Appleton Paper Inc. is sold under the trade name "CF Ink." In application, it is applied to lower surface 24 of translucent paper ply 20 resulting in layer 22 which will be capable of producing positive visible images on both ply 20 and ply 30 when the top surface 34 of ply 30 has a layer 32 of microencapsulated dyes disposed thereon. The coatable resin is applied to the translucent paper ply 20 as the last color down using a dry-offset process with a full offset tower inking system or an equivalent rubber tower. Ink flow and run speed are adjusted to provide an ink film laydown which gives a resin film thickness of about 0.3 to 0.4 mil. Coverage at this laydown rate is approximately one pound of resin per 200,000 sq/in. The ability of the resin to make an image declines slightly after the resin has dried. The image obtained should therefore be checked to ensure the image is slightly better than the image that will be needed.

According to the present invention, the application of pressure to the form results in a chemically generated, positive image on both lower surface 24 of top translucent ply 20 and upper surface 34 of second ply 30 even though this is contrary to the conventional disposition of images on the plies of known carbonless transaction forms. The legibility of the image on lower surface 24 of top ply 20 is significantly enhanced if the paper is initially coated with a colored pigment which contrasts with the color of the image. If desired, a mill manufactured translucent or semi-translucent paper, which has characteristics similar to paper made in accordance with the method described in U.S. Pat. No. 4,730,848, may be used.

The following example describes a two ply transaction form in accordance with the present invention.

EXAMPLE

A two ply transaction form is made according to manufacturing and printing procedures well known to those skilled in the art.

A top translucent ply may be a specialty or commodity grade translucent, semi-translucent paper or a translucent paper made in accordance with the method described in U.S. Pat. No. 4,730,848. For example, a translucent paper may be coated with a white opaque ink formulated from 55% titanium oxide, 2% wax, 28% middle distillate oil, and 15% hydrocarbon resin. The ink is printed on the lower surface of the translucent paper at the beginning of the printing process. In the final step of the printing process, the lower surface of the translucent ply, which will be adjacent to the second ply, is coated with a resin sold under the trade name "CF Ink" by Appleton Papers Inc., Appleton, Wis. The "CF Ink" is a proprietary Appleton formulation. It is used to produce images with NCR Paper® brand carbonless papers sold by Appleton that have been coated with microencapsulated dyes. Additionally, the "CF Ink" may be used to generate images with papers that have been coated with microencapsulated dyes which are made by other manufacturers that make compatible carbonless papers.

The second ply is made from a paper having a surface coated with a microencapsulated colorless dye sold under the trade name "CB" NCR Paper® brand of carbonless paper by Appleton Papers Inc. The "CB" paper is processed and printed using known methods. In addition, the "CB" paper may also be coated, in a final printing step, with the "CF Ink" if an image with a greater intensity is desired.

One end of the ply of the resin coated translucent paper is joined to one end of the ply of the the "CB" paper by a suitable adhesive using known methods to yield a finished two ply transaction form.

Although the transaction form described in the above example has the chemically reactive resin coating applied to the lower surface of the top ply and and the microencapsulated dyes applied to the upper surface of the second ply, other permutations of applying the chemically reactive image producing agents to the adjacent surfaces of the two mating plies may also produce visual, positive images. Various permutations which are believed to yield positive images on both plies are shown in Chart 1.

CHART 1

| Top Ply Coating (Bottom Surface) | Second Ply Coating (Top Surface) |
|---|---|
| CF | CB |
| CF | CB/CF comb. |
| CB/CF comb. | CB |
| CB/CF comb. | CF |
| CB | CF |
| CB | CB/CF comb. |

CF = Chemically reactive resin coating
CB = Microencapsulated colorless dye
CB/CF comb. = Chemically reactive resin coating applied to a surface containing the microencapsulated colorless dye The foregoing detailed description has been given for clearness of understanding only, and no unnecessary limitations should be understood therefrom, as modifications will be readily apparent to those skilled in the art.

What is claimed is:

1. A carbonless, multiple ply business form having a plurality of transaction slips or plies providing multiple copies of a transaction when said form is imprinted by an imprinting machine using a card having an embossed surface, by an impact printer or by a hand held stylus, said form comprising:

at least a first substantially translucent ply having an upper surface and a lower surface in a stacked relationship to a second ply having an upper surface and a lower surface, said lower surface of said translucent ply comprising a first layer of a first colorless, chemically reactive positive image producing agent in contact with said upper surface of said second ply, said upper surface of said second ply comprising a second layer of a second colorless, chemically reactive positive image producing agent, said first and second chemically reactive image producing agents being adapted to react with each other upon application of sufficient imprinting pressure to said form whereby, said agents contact each other and react under said pressure to provide visible, positive images on said lower surface of said translucent ply and on said upper surface of said second ply; and, said visible, positive image on said lower surface of said translucent ply being readable through said upper layer of said translucent ply.

2. The business form of claim 1 wherein one of said first and second chemically reactive image producing agents comprises a microencapsulated colorless dye on one of said coated surfaces and said other agent comprises a chemically reactive coatable resin on said other coated surface.

3. The business form of claim 2 wherein said visible, positive images are colored.

4. The business form of claim 3 wherein said visible, positive image is blue or black.

5. The business form of claim 2 wherein said first layer of said translucent ply comprises a chemically reactive coatable resin and said second layer of said second ply comprises a microencapsulated colorless dye.

6. The business form of claim 5 wherein said first layer of said translucent ply comprises a chemically reactive coatable resin and said second layer of said second ply comprises a microencapsulated colorless dye and a chemically reactive coatable resin.

7. The business form of claim 2 wherein said first layer of said translucent ply comprises a microencapsulated colorless dye and said second layer of said second ply comprises a chemically reactive coatable resin.

8. The business form of claim 1 wherein said lower surface of said substantially translucent ply is initially coated with a pigment coating.

9. The business form of claim 8 wherein said substantially translucent ply is a translucent paper.

10. The business form of claim 9 wherein said substantially translucent ply is a semi-translucent paper.

11. The business form of claim 8 wherein the color of said pigment coating contrasts with the color of said positive image.

12. The business form of claim 2 wherein said chemically reactive coatable resin is a colorless coating applied to said translucent ply.

13. The business form of claim 1 wherein said plies are essentially smear and smudge proof.

14. The business form of claim 1 wherein said form comprises more than two plies wherein each ply yields a positive image on at least one surface when sufficient pressure is applied to said upper surface of said first ply.

15. A carbonless, multiple ply business form having a plurality of transaction slips or plies providing multiple copies of a transaction when said form is imprinted, said form comprising:

a stack of at least a first substantially translucent ply having a lower surface comprising a layer of a first colorless, chemically reactive, positive image producing agent and a second ply having an upper surface comprising a layer of a second colorless, chemically reactive, positive image producing agent;

wherein the first and second chemically reactive, positive image producing agents are reactable with one another upon application of sufficient imprinting pressure upon said form whereby said agents contact each other and react under said pressure to provide visible, positive images on the lower surface of the translucent ply and the upper surface of the second ply; and wherein the visible, positive image on the translucent ply is aligned with and superimposable over the visible, positive image on the second ply.

16. The business form of claim 15 wherein said visible, positive image on the lower surface of said translucent ply is readable through an upper surface of said translucent ply.

17. The business form of claim 16 wherein said visible, positive images are colored.

18. The business form of claim 17 wherein said visible, positive images are blue or black.

19. The business form of claim 15 wherein said first colorless, chemically reactive, image producing agent comprises a chemically reactive coatable resin and said second colorless, chemically reactive, image producing agent comprises a microencapsulated colorless dye.

20. The business form of claim 19 wherein said translucent and second plies are substantially smear and smudge proof.

21. The business form of claim 15 wherein said form further comprises more than two plies wherein each ply yields a visible, positive image on at least one surface after a single imprinting; and wherein each visible, positive image is aligned with and superimposable over said visible positive images on adjacent plies.

22. The business form of claim 15 wherein said form is imprinted by an imprinting machine using a card having an embossed surface.

23. The business form of claim 15 wherein said form is imprinted by an impact printer.

24. The business form of claim 15 wherein said form is imprinted by a hand-held stylus.

25. A carbonless, multiple ply business form having a plurality of transaction slips or plies providing multiple copies of a transaction when said form is imprinted by an imprinting machine using a card having an embossed surface, by an impact printer or by a hand held stylus, said form comprising:

at least a first ply having an upper surface and a lower surface and a second ply having an upper surface and a lower surface;

said first and second plies being in a stacked relationship;

said lower surface of said first ply including a first means disposed thereon for producing a positive image on said lower first ply surface;

said upper surface of said second ply including a second means disposed thereon for producing a positive image on said upper second ply surface when said first means on said lower first ply surface contacts and reacts with said second means on said upper surface of said second ply upon application of sufficient imprinting pressure; and, said first ply comprising a material which permits said positive image generated on said lower surface of said first ply to be readable through said upper surface of said first ply wherein said first ply material is substantially translucent.

26. The carbonless form of claim 25 wherein one of said first and second image producing means comprises a CF coating and said other of said first and second image producing means comprises a CB coating.

27. The carbonless form of claim 25, wherein one of said first and second image producing means comprises a CB/CF combination coating and said other of said first and second image producing means comprises a CF coating.

28. The carbonless form of claim 25 wherein one of said first and second image producing means comprises a CB/CF combination coating and said other of said first and second image producing means comprises a CB coating.

29. The carbonless form of claim 25 wherein one of said first and second image producing means comprises a CF/CB combination coating and said other of said first and second image producing means comprises a CB/CF combination coating.

* * * * *